United States Patent [19]

Zapp

[11] 4,078,687

[45] Mar. 14, 1978

[54] CHILD-PROOF SCREW-CAP CLOSURE

[76] Inventor: Walter Zapp, Ebenau 877, Oberegg, Switzerland, 9413

[21] Appl. No.: 756,683

[22] Filed: Jan. 4, 1977

Related U.S. Application Data

[63] Continuation of Ser. No. 689,124, May 24, 1976, abandoned.

[30] Foreign Application Priority Data

Jun. 3, 1975 Switzerland ..... 7221/75

[51] Int. Cl.[2] ..... B65D 55/02; B65D 85/56; A61J 1/00

[52] U.S. Cl. ..... 215/210; 215/219

[58] Field of Search ..... 215/210, 219

[56] References Cited

U.S. PATENT DOCUMENTS

| | | | |
|---|---|---|---|
| 2,372,482 | 3/1945 | Genei | 215/210 |
| 3,734,330 | 5/1973 | Danner et al. | 215/210 |

*Primary Examiner*—George T. Hall

*Attorney, Agent, or Firm*—Gilbert L. Wells; Heinrich W. Herzfeld

[57] ABSTRACT

A child-proof screw-cap closure is described which can be screwed onto a bottle or the like container and comprises an inner cap, an outer cap, a coupling member and a sealing member, which inner cap possesses an inner chamber and a cavity, connected with one another by a passage and a channel with a window between the cavity and the chamber, and which outer cap possesses a projecting zone with at least one niche, which zone projects so far into the interior of the outer cap that, in the non-actuating position, it at least partially covers the window of the channel and prevents passage of the coupling member through the channel, whilst when the outer cap is rotated so that the niche faces the window, the coupling member can pass from the cavity into the window and project into the niche, as a result of which a positive engagement is made between the inner and outer cap and both caps can be unscrewed from the mouth of the container.

10 Claims, 10 Drawing Figures

CHILD-PROOF SCREW-CAP CLOSURE

This is a continuation of application Ser. No. 689,124 filed May 24, 1976 now abandoned.

BACKGROUND OF THE INVENTION

The present invention relates to a child-proof screw-cap closure having a. an inner cap which can be screwed onto the dispensing orifice of a container, b. an outer cap which covers the said inner cap and, in the non-actuation position, is rotatably carried thereon without causing it to execute the same movement, c. a coupling member which, when the closure is actuated to open it, produces a positive engagement between the inner cap and the outer cap and d. a sealing member which can be mounted between the orifice rim of the container and the inner wall of the inner cap.

In recent years there have been many attempts to invent a child-proof screw closure, which can only be opened if certain manipulations are executed with the cap which acts as the closure of a container containing tablets or the like, for example a small bottle or box. Most of these known devices comprise the four above-mentioned components. The third component is frequently a spring-type member, which presents the hazard of fatigue phenomena, or even of breaking off. Since it is in most cases necessary to manufacture this component from metal or from a plastic, for which latter case the only suitable method of manufacture is, in general, a modern injection molding process, a difficulty which readily presents itself is to find suitable molds and cores which will not be so highly complicated as to make the process too expensive.

Accordingly, it is an object of the present invention to provide a child-proof screw-cap closure which can be manufactured simply, without complicated molds and cores, by injection-molding of a plastic, and which also does not present a risk of fatigue or breaking-off.

According to the invention, this object is achieved by a child-proof screw-cap closure of the type initially described, which is characterized in that the inner cap possesses, on its inside, an inner chamber (which faces the container) and also possesses a cavity in its upper end face, which chamber and cavity are connected with one another by a first passage which at all times freely permits the coupling member to pass, that a second ball-circulating channel, which connects the cavity to the inner chamber, is provided for the coupling member, which channel possesses a window in the outer side wall of the inner cap, between the cavity and the chamber, and that the outer cap possesses, on its inner wall, a projecting portion with at least one niche, which portion is so arranged that, in the non-actuating position, it at least partially covers the window of the ball-circulating channel and thereby prevents passage of the coupling member through the said channel, whilst, when the outer cap is rotated so that the niche faces the window, the coupling member can pass from the cavity into the window, whilst at the same time projecting into the niche, as a result of which the aforesaid positive connection is made between the inner cap and the outer cap and both caps can be unscrewed from the mouth of the container.

Preferably, a recess is provided in the side wall of the inner cap, which recess extends below the window and is deeper than the lower edge of the niche in the inner wall of the outer cap, and the coupling member rests against the bottom face of the said recess when it projects into the niche.

It is also preferred that the region of the window in the outer side wall of the inner cap should have a step, with the reach of the circulating channel between the window and the cavity terminating above the step, and the reach of the channel between the window and the chamber terminating below the step in the side wall of the cap and being staggered relative to the orifice of the first reach of the channel, in the direction in which the closure is rotated to close it, so that the coupling member projecting into the niche of the outer cap is pushed into the orifice of the second reach of the channel on turning the outer cap in the closing direction, and thus is able to leave the niche, whereby the outer cap and the inner cap become again disengaged.

The entry passage from the second reach of the channel into the chamber can advantageously also be so designed that the coupling member is prevented from entering this reach of the channel from the chamber.

It is also advantageous to provide, between the outer cap and the inner cap, a locking device by means of which the inner cap is moved together with the outer cap when the latter is rotated in the closing direction, whilst the inner cap is released when rotating the outer cap in the opening direction.

Preferably, that marginal edge of the niche in the inner wall of the outer cap, which on rotation of the latter in the opening direction is brought into contact with the coupling member projecting into the niche, is so arranged relative to the coupling marginal edge of the window of the inner cap above the step, against which the coupling member is pressed on rotating the closure to open it, that, with the coupling member removed from the niche, the said edge of the niche does not come into engagement with the coupling marginal edge of the window. For this purpose, the annular step, adjacent to the window, in the outer wall of the inner cap can have ramps which rise in the opening direction of rotation and are of sufficient length so as to prevent, through raising the lifting faces, sliding on the ramps, of an annular shoulder in the inner wall of the outer cap, any engagement between the said niche edge and the coupling marginal edge of the window.

Preferably, the coupling member is a ball, and the sealing member is advantageously firmly connected to the inner cap, so as to seal the inner chamber, whereby the coupling member, especially the ball, is prevented from dropping out. Finally, the sealing member can possess a cavity, on its side which faces the inner chamber of the inner cap, in which the coupling member is held securely, to prevent a shift in its position, when the cap is in the normal upright position.

Further details of the invention will be seen from the description, given below, of a preferred embodiment thereof, in conjunction with the attached drawings. In these:

Figure 1:
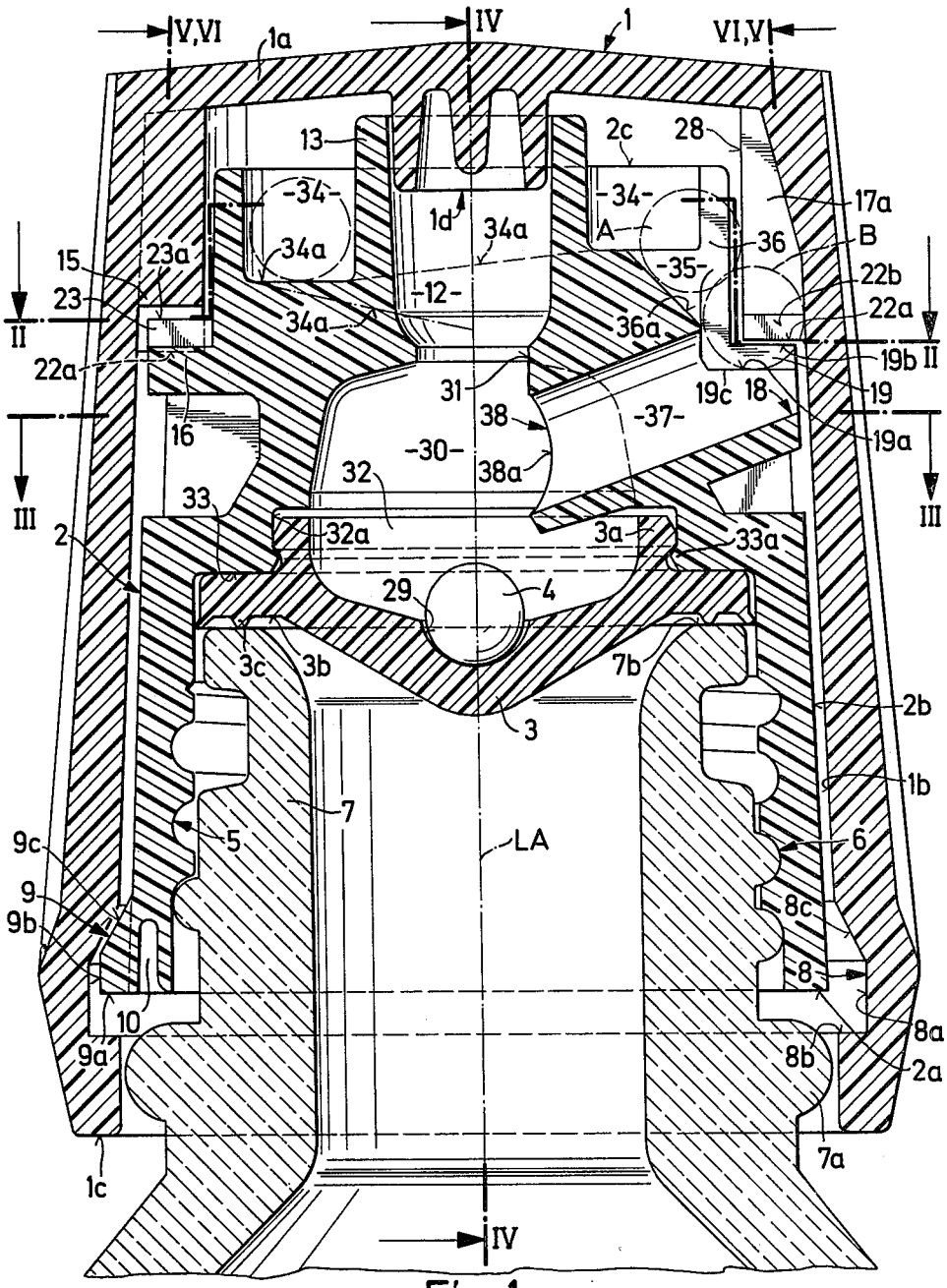
FIG. 1 shows a longitudinal section through the bottle closure of the invention, in its preferred embodiment, mounted on the mouth of a bottle, which mouth is provided with an external thread.

The embodiment shown comprises an outer cap 1 which is mounted so as to be loosely rotatable on an inner cap 2, which in turn accomodates a sealing member 3 and, in its hollow interior 12,30 a ball 4 which serves as a coupling member. The inner cap 2 is screwed, by its inner thread 5, onto a corresponding outer thread 6 of the container 7 which is to be closed in a child-proof manner and which is represented as a bottle in the drawings.

The outer cap 1, devised in the shape of a cup, with its upper end 10 closed, possesses, in its inner wall **1*b*, near its open lower end 1*c*, an annular groove 8, the bottom 8*a* of which groove forms a right angle, or even an acute angle, with the lower side wall 8*b* of the annular groove, whilst the upper side wall 8*c* of the annular groove forms a gradual transition, e.g. at an obtuse angle, firstly with the groove bottom 8*a* of the groove, and secondly with the adjoining inner wall 1*b* of the outer cap 1. A plurality, e.g. two or preferably three, locking members 9, e.g. shaped as noses, engage in the groove 8, and project, in the vicinity of the lower rim 2*a* of the bell-shaped inner cap 2, from the outer wall 2*b* of the inner cap 2. Corresponding to the construction of the side walls of the groove 8, the lower end wall 9*a* of the locking nose 9 is also constructed to form a right angle or acute angle with the end face 9*b* of the nose, whilst the upper side wall 9*c* of the nose is chamfered. The nose 9 can be pressed somewhat elastically into the wall of the inner cap 2 by virtue of an arc-shaped gap 10 located behind each nose 9 and opening out into the lower rim 2*a* of the inner cap 2. This makes it possible to push the outer cap 1 easily onto the inner cap 2; because of sufficient play between the groove 8 and the noses 9 the outer cap 1 can also easily be rotated on the inner cap 2, about the common longitudinal axis LA, in the opening direction, without carrying the inner cap 2 with it, this being all the more possible as a slight amount of play is also provided between the inner wall 1*b* of the outer cap 1 and the outer wall 2*b* of the inner cap 2. (In the embodiment shown, "opening direction" means anti-clockwise rotation when looking onto the upper end 1*a* of the cap 1**.)

In its upper end face **2*c*, the inner cap 2 possesses an upper cavity 12, which is surrounded by a sleeve 13, in which there is provided a window or slot 14. A guide peg 1*d*, which projects on the inner side of the upper end wall 1*a* of the outer cap 1, extends a short way into the upper end of the cavity 12, with slight play, so as to provide a guide. At its lower end 1*c*, the outer cap 1 is also guided loosely, by its inner wall 1*b*, on an annular bead 7*a* of the bottle 7**.

Though, as already mentioned above, the outer cap 1 rests on the inner cap 2 so as to be rotatable in the opening direction, removal of the outer cap 1 from the inner cap 2 is prevented by the lower side wall **8*b* of the groove 8 abutting the lower end wall 9*a* of the nose 9 if an attempt is made to pull off the outer cap 1**. Accordingly, the outer and inner cap can no longer be separated after they have been assembled.

Figure 2:
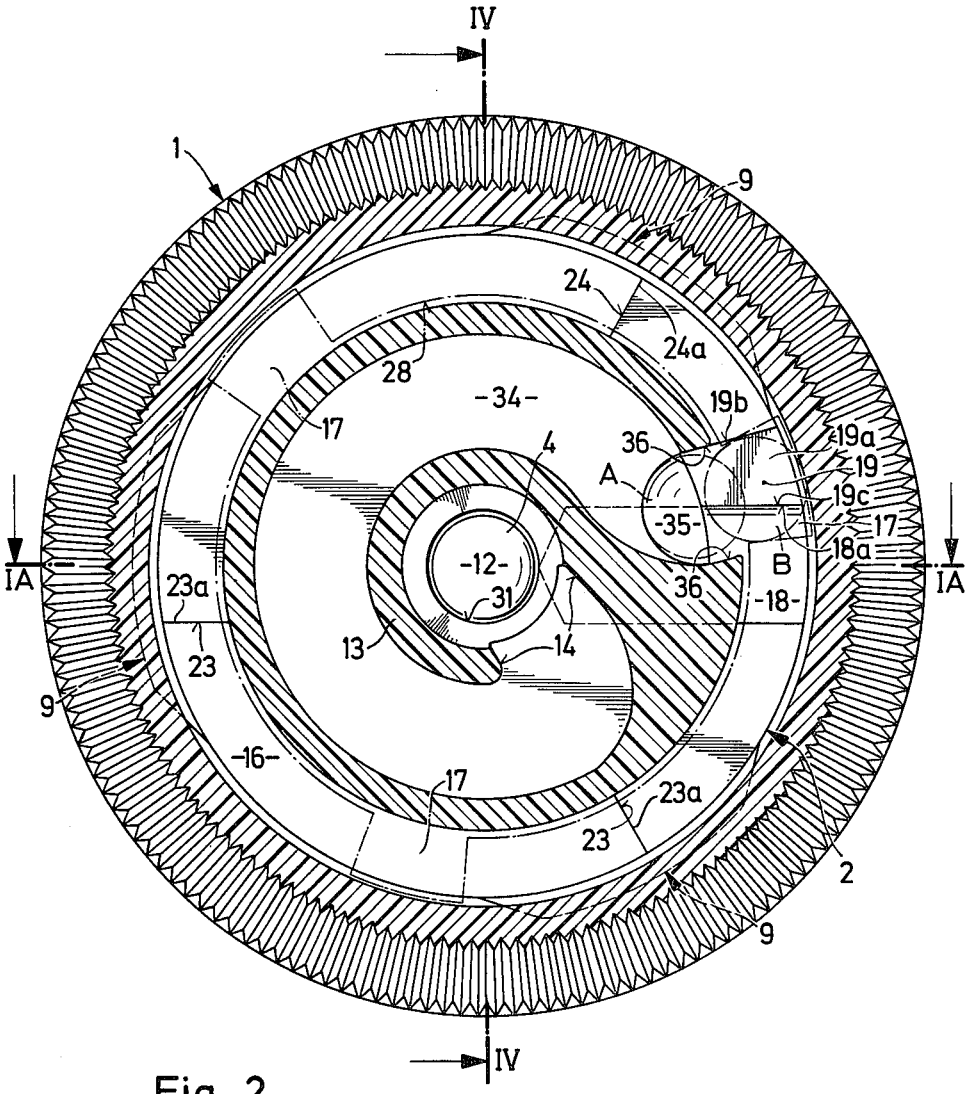
FIG. 2 shows a transverse section through this embodiment, along a plane indicated by line II—II in FIG. 1.
Figure 3:
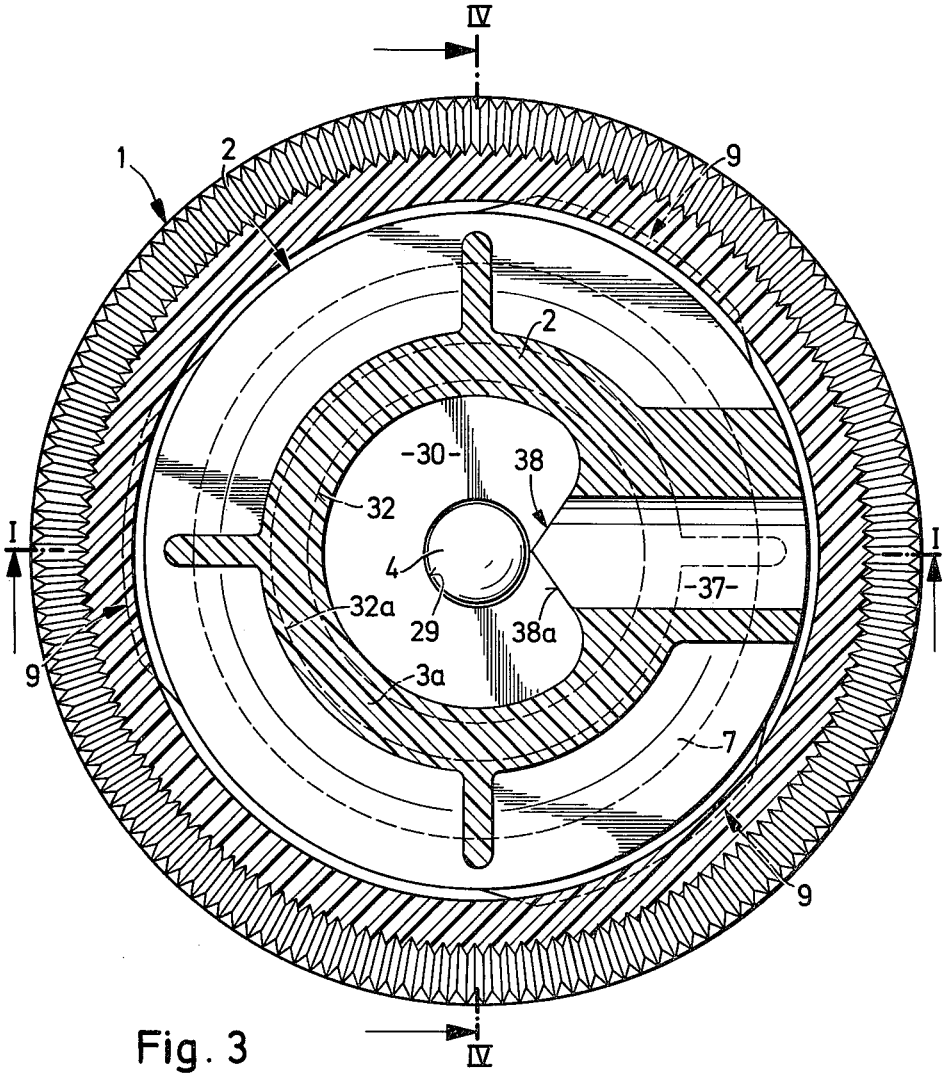
FIG. 3 shows a cross-section through the same embodiment, along a plane indicated by the line III—III in FIG. 1.
Figure 4:
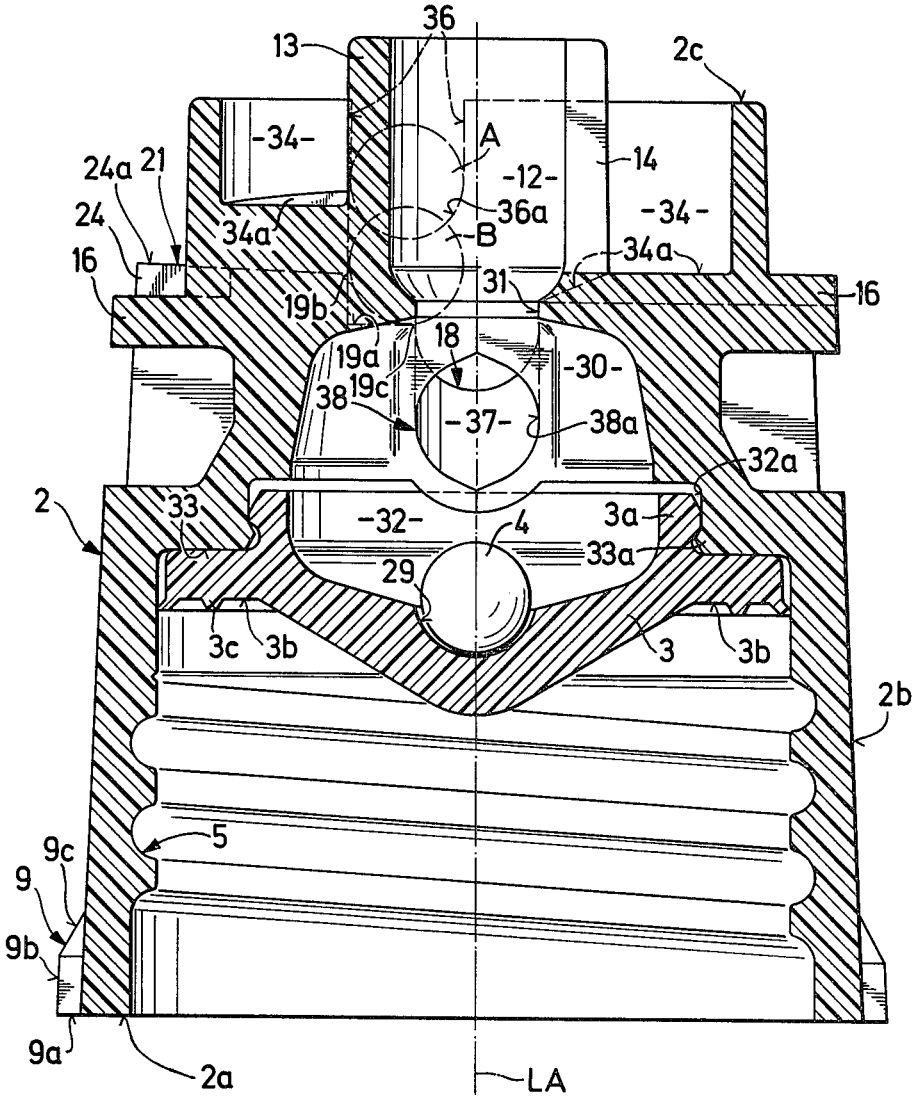
FIG. 4 shows a longitudinal section through the inner cap of the previously shown embodiment, along the lines IV—IV indicated by broken lines in FIGS. 1 and 2.

In the inner wall **1*b* of the outer cap 1 there is provided an annular shoulder 15, whilst the outer wall 2*b* has an annular step 16 which faces the shoulder 15, partly at a distance therefrom and partly in contact therewith. As may be seen from the unwrapped sectional views of the two zones, again marked 15 and 16, in FIGS. 5 and 6, the annular shoulder 15 slides unhindered over the annular step 16 of the inner cap 2 on turning the outer cap 1 in the opening direction. A number of niches 17 (FIGS. 2, 5 and 6) are provided in the inner wall 1*b* of the outer cap 1 which niches are uniformly distributed about the outer periphery of the inner cap 2, these niches being at such height above the open rim of the lower end 1*c* of the outer cap 1 that their upper zone projects beyond the zone of contact between the annular shoulder 15 and the annular step 16, whilst their lower zone extends to slightly below this contact zone. The width of each niche 17 is somewhat greater than the diameter of the ball 4. In the annular step 16 of the inner cap 2, a recess 18, preferably of semi-circular cross-section, is provided at one point, the width of which recess is approximately the same as that of the niche 17 and somewhat larger than the diameter of the ball 4. The depth of the recess 18 is less than the diameter of the ball 4, and is preferably about half the size of the latter. Furthermore, an additional and shallower recess 19 is provided in the annular step 16, next to the recess 18, and the recess 19 adjoins the recess 18**, in the opening direction, in a staggered manner, in such a way as not to leave a dividing partition between the two recesses.

However, the bottom face **19*a* of the shallower recess 19 in the annular step 16 forms, with the side wall 18*a* of the recess 18, the lower step 19*c* of two staircase-like steps 19*b* and 19*c*. On rotating the outer cap 1 relative to the inner cap 2, in the opening direction, the niche 17 moves from the position shown in FIG. 6 and first passes the recess 18 and then the recess 19. Upon rotation in the opening direction in this way, the ramps 20 and 21, which rise at a shallow angle from the upper face of the annular step 16, slightly lift the outer cap 1 which latter is provided with correspondingly chamfered lifting faces 22 in its annular shoulder 15, until the terminal edges 22*a* of the lifting faces 22 formed with the chamfers 22*b* provided in the adjacent side walls 17*a* of the niches 17 at the lower open end of each niche (which edges, with this direction of rotation, are the trailing edges) slide over the terminal edges 23*a*,24*a* formed between the ramps 20,21 and the perpendicular abutments 23, 24 at the end of said ramps 20,21. At this moment, the terminal edges 23*a*,24*a* of ramps 20,21 enter the niches 17 by a slight amount, but excessively deep penetration is prevented by working edges 26 of locking noses 25, which project from the surface of the annular shoulder 15 at the end — in the opening direction — of the lifting faces 22, and are seated, during opening rotation, on the next adjacent ramp 20 and 21 and thus initiate a renewed lift of the outer cap 1 relative to the annular step 16 of the inner cap 2**.

In contrast, on turning the outer cap 1 relative to the inner cap 2 in the closing direction, the lifting faces 22 of the annular shoulder 15 of the outer cap 1 run downwards on the ramps 20 and 21 until the locking noses 25 abut the vertical stops 23 and 24 by their vertical locking walls 27, which in the closing direction point forwards, and thus prevent any further rotation of the outer cap 1 in the closing direction, since the inner cap 2 is already firmly screwed onto the outer thread 6 of the bottle 7.

In its interior, the inner cap 2 has, in addition to the previously mentioned upper cavity 12 in its upper end wall 2*c*, a chamber 30 opening towards the interior of the bottle 7 and connected to the cavity 12 via a central passage 31, the internal width of which is greater than the diameter of the ball 4. In the direction of the interior of the bottle 7, the chamber 30 opens into a cavity 32 of larger diameter, in the annular side wall 32*a* of which cavity 32 there is provided an annular shoulder 33, the annular face of which points towards the interior of the bottle 7, and which carries an annular bead 33*a* on its periphery. A sealing member 3 is firmly pressed against the annular wall 32*a* and the annular shoulder 33 by means of a bush 3*a*, so that the sealing member 3 does not become detached, on unscrewing the inner cap 2 from the outer thread 6 of the bottle 7, even if, after prolonged non-use, the underside 3*b* of the sealing member 3 may have stuck to the end face 7*b* of the orifice rim of the bottle 7, due to liquid which has dried on. To prevent such sticking as far as possible, a sealing bead 3*c* is provided on the underside 3*b* of the sealing member 3.

Figure 5:
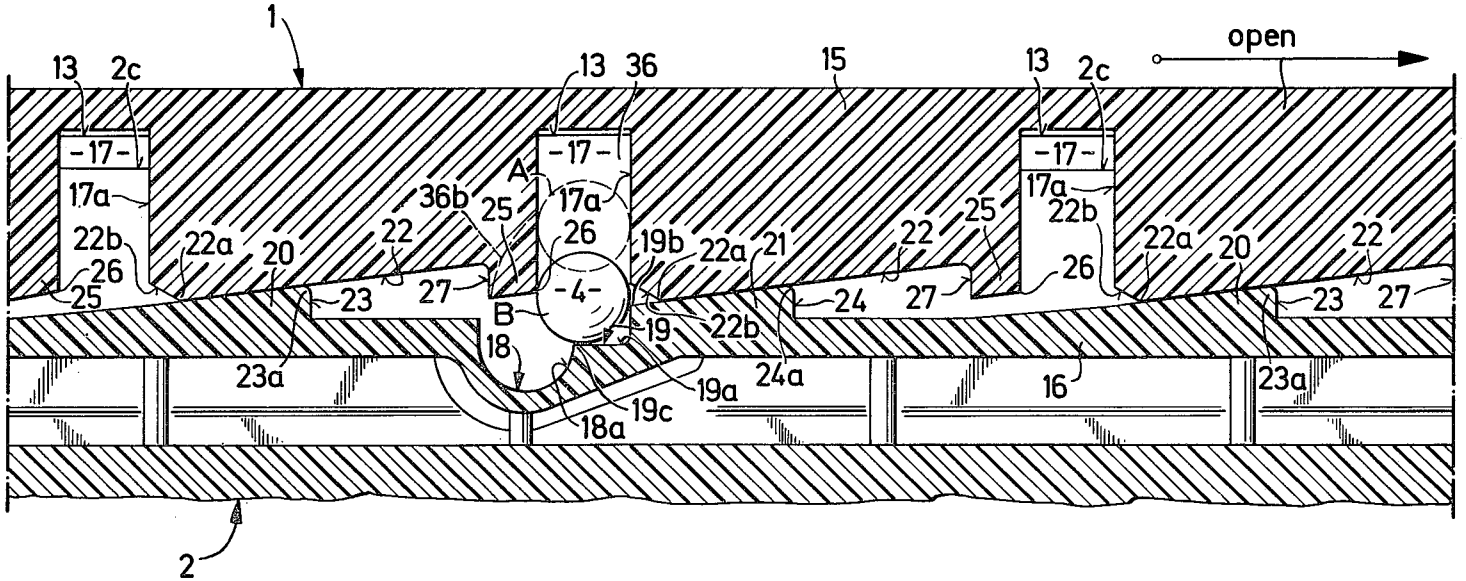
FIG. 5 shows an unwrapped view of the zone of contact between the outer cap and the inner cap in the locked position.

From the upper cavity 12, an annular channel 34 extends through the window 14, the bottom 34*a* of the channel rising upwards at an angle, i.e. towards the upper end 1*a* of the cap 1; on turning the bottle 7 about its longitudinal axis in an anti-clockwise direction (when looking onto the cap 1), the ball 4 can roll through the annular channel 34 into the guide 35 which leads downwards inclined at an angle (i.e. towards the interior of the container), and which guide 35 opens, through a window 36 in the outer wall 2*b* of the inner cap 2, above the annular step 16. Whilst the cross-section of the annular channel 34 is such that the ball 4 can roll unhindered through the channel 34, the internal width of the guide 35, measured radially to the longitudinal axis of the container, decreases so that at the window 36 it only corresponds to about half the diameter of the ball 4. Hence, on rolling downwards into the guide 35, the ball 4 comes to rest against the part-zone 28 of the inner wall 1*b* of the outer cap 1, above the annular shoulder 15 (ball 4 shown in broken lines in position A). Only when one of the niches 17 has been brought into alignment with the window 36 by rotating the cap 1 can the ball 4 enter this window 36, so that one half of the ball 4 projects into the niche 17 and at the same time the ball 4 rests on the bottom face 19*a* of the shallower recess 19 in the annular step 16 of the inner cap 2 (ball 4 shown in dash-and-dotted lines in position B) and is prevented from rolling down into the deeper recess 18 of the annular step 16 by the forward (in the opening direction) working edge 26 of the locking nose 25 (FIG. 5), since, on alignment of the window 36 with the niche 17, the distance between the working edge 26 and the step edge 19*c* (between the bottom face 19*a* and the side wall 18*a*) is smaller than the diameter of the ball 4 (FIG. 5). A return guide 37 leads downwards at an angle from the recess 18 and opens in the chamber 30, the annular edge 38*a* surrounding the orifice 38 of the guide 37 projecting sufficiently far into the chamber 30 that the ball 4 cannot roll out of the chamber 30 back again into the return guide 37 through the orifice 38, and instead is always deflected by the orifice edge 38*a* into the passage 31 and the recess 12 when the container 7 is tilted or inverted.

In the upright position of the closed bottle 7, the ball 4 rests in a nest 29 in the inner wall of the sealing member 3.

The inner cap 2, the outer cap 1 and the sealing member 3 are preferably manufactured from a thermoplastic resin material, by injection molding. The core used for the manufacture of the outer cap 1 having an annular groove 9, is preferably an undercut core or collapsible core of the type described in U.S. Patent No. 3,247,548.

The balls may be manufactured from steel, hard alloy, titanium, aluminum, alloys such as brass or bronze, glass or porcelain, or synthetic plastics material such as polytetrafluoroethylene (Teflon®), polypropylene (Hostalen PP ®), polyhexamethylen adipamide (Polyamide A) or an acetal copolymer (Hostaform C) and materials having similar properties.

Preferably, the inner part is manufactured from a low pressure polyethylene such as Lupolen 5011 K. The coupling member used is preferably a nickel-plated lead ball of about 4 mm diameter.

Instead of providing the noses 9 on the outer wall 2*b* of the inner cap 2 and the annular groove 8 in the inner wall 1*b* of the outer cap 1, it is of course also possible conversely to allow the noses 9 to project from the inner wall 1b of the outer cap 1 and to provide a corresponding annular groove 8 on the outer wall 2*b* of the inner cap 2.

Assembling the Closure

For assembly, the sealing member 3 is first pressed into the cavity 32 of the inner cap 2 and the ball 4 is then introduced through the cavity 12 or the window 36 into the chamber 30, causing it to lie in the nest 29, after which the outer cap 1 is pressed over the inner cap 2 until the noses 9 snap into the annular groove 8; the closure which has thus been assembled cannot be dismantled without destruction and can now be screwed onto the thread 6 of the bottle 7 so as to provide a tight seal, since the locking walls 27 of the locking noses 25 of the outer cap 1 carry the inner cap 2 with the outer cap 1, through coming up against the stops 23,24, until the closure has been completely screwed onto the thread 6 of the bottle 7. In the course thereof, the sealing bead 3*c* of the sealing member 3 is pressed against the frontal face 7*b* of the orifice rim of the bottle 7 to form a hermetic seal.

Actuation of the Closure during Opening and Closing.

On simply turning the outer cap 1 in the opening direction, the inner cap 2 cannot be carried with the outer cap 1, since the lifting faces 22 of the annular shouler 15 of the outer cap 1 slide over the ramps 20,21 of the annular step 16 of the inner cap 2.

Figure 7:
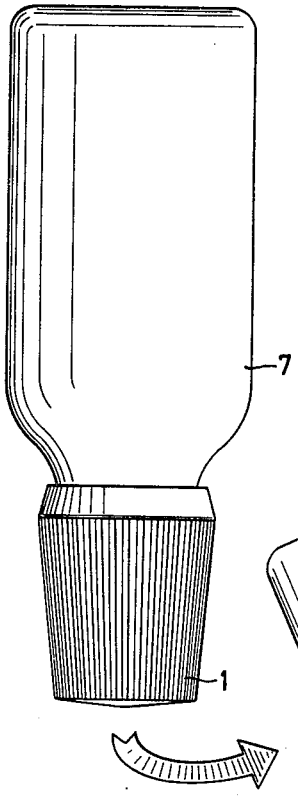
FIGS. 7, 8 and 9 finally show a bottle, with a closure according to the invention screwed thereon, in three successive positions required to be passed through during closing and opening.
Figure 8:
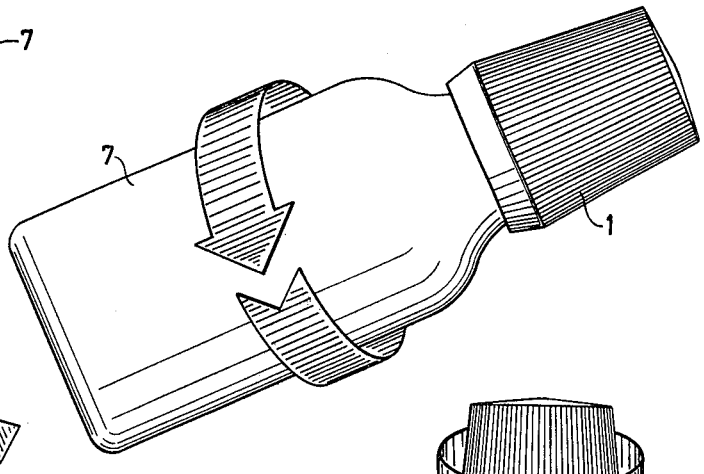

Instead, to open the closure the bottle 7 must first be inverted (FIG. 7), as a result of which the ball 4 falls out of the nest 29, through the passage 31 and the cavity 12, onto the roof of the outer cap 1, which, in this position of the bottle 7, forms a bottom wall. The bottle 7 must now be raised with its cap 1 to a horizontal position, or only slightly out of the horizontal, preferably with the closure somewhat higher than the bottom of the bottle 7 (FIG. 8) and must then, in the case of the embodiment shown, be turned anti-clockwise, viewed onto the end of the closure, about the longitudinal axis of the bottle 7, through at least one turn. For safety, it is advisable to execute two complete turns. In the course thereof, the ball 4 rolls out of the cavity 12 and through the annular channel 34 (FIG. 2) into the guide 35 and comes to rest against the inner wall 1*b*, before it is able to enter the window 36, since the bottom 36*a* is chamfered so that its distance from the inner wall 1*b* of the outer cap 1 becomes too small to permit the ball 4 to roll down further into the window 36 (abutting position 17 of the ball).

Figure 9:
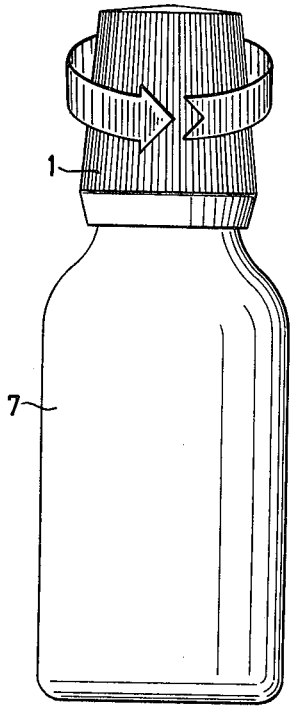

The bottle 7 can now be returned to its upright position (FIG. 9). If now the outer cap 1 is turned in the opening direction, one of the niches 16 comes into alignment with the window 36 and the ball 4 can roll into the window 36 until it rests on the bottom face 19*a* of the recess 19 (operating position B), with the outer half of the ball 4 projecting into the niche 17.

Since the rotation of the outer cap 1 is continued uninterruptedly, the working edge 26 of the locking nose 25 now encounters the ball 4, which is in working position B, and presses the ball 4 against the carrier edge 19*b*, which is located at the upper rim of the recess 19, where it adjoins the ramp 21, so that now the inner cap 2 is carried with the outer cap 1 as the latter is turned further, and is unscrewed from the thread 6 of the bottle 7.

If the bottle 7 is to be reclosed, the closure, in which the outer cap 1 and the inner cap 2 can still be locked to one another by the ball 4 located in the working position B, is screwed by means of the inner thread 5 of the inner cap 2 onto the outer thread 6 of the bottle 7.

On turning the outer cap 1 in the closing direction, the said locking attributable to the ball 4 being in the working position B is immediately released in that the trailing edge 22*a* of the niche 17 pushes the ball 4 from where it rests on the bottom face 19*a* of the recess 19 down into the recess 18, from where the ball 4 rolls back, through the channel 37 and the orifice 38, into the chamber 30, and seats in the nest 29 of the sealing member 3.

Whilst, in the embodiment shown, three niches 17 are provided in the inner wall 1*b* and the part 28 of the periphery of the outer cap 1, so that at most one-third of a revolution of the outer cap 1 in the opening direction suffices to bring one of the niches 17 into alignment with the window 36, it is also possible to provide one or two niches, or even four or more niches. In the case of one or two niches, security against inadvertent opening is increased, since half a rotation may be required with two niches, and a whole rotation in the case of one niche, in order to bring the niche 17 and the window 36 into alignment. Conversely, the presence of four or more niches reduces this security because of the greater probability that one of the niches 17 may accidentally be brought into alignment with the window 36.

For reliable operation, a preferred embodiment comprises the following features:

The inner cap 2 and the outer cap 1 must be connected so that in non-locked position, they can be rotated relative to one another with minimum possible frictional resistance, so that even if the closure is only lightly screwed onto the bottle, it cannot be opened without coupling the two caps by the ball 4. For this purpose, it is preferable to center the outer cap 1 at a position of minimum diameter (guide tube 1*d* and sleeve 13) with little play. For the same reason, the lower rim 1*c* of the outer cap 1 must be guided on the bottle neck bead 14, so that frictional contact of the caps with one another does not take place at any other point. It would seem that such frictional contact can nevertheless be produced easily by simultaneously turning and lifting the outer cap 1, which would grip the two lateral securing noses 9 by friction. However, this attempt to open the bottle would prove unsuccessful, since the upwardly exerted pressure equally increases the resistance offered by the thread. This would in part also occur if an attempt were made to increase the friction of the upper centering device (guide tube 1*d*) by lateral pressure.

Figure 1A:
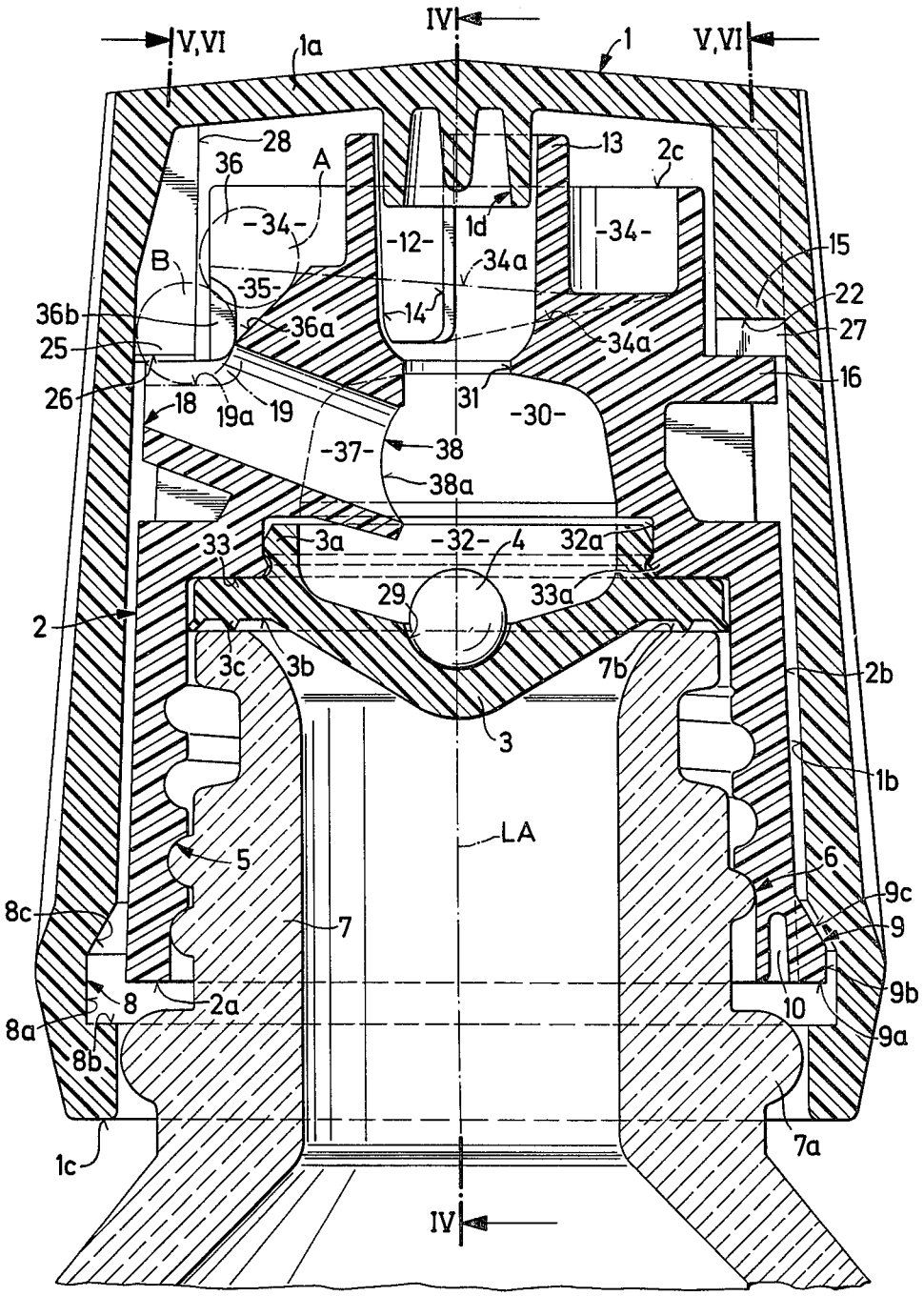
FIG. 1A shows a longitudinal section as in FIG. 1, but viewed from the opposite side.

The locking noses 9 must not only secure the caps 1 and 2 to one another but must at the same time leave them sufficient play to permit mutual locking and unlocking. FIGS. 1, 1A and 5 show approximately the highest position of the outer cap 1 relative to the inner cap 2, and FIG. 6 the lowest postion, for locking engagement.

The sealing member 3, which is known per se, preferably consists of a soft, elastic plastic and has the subsidiary function of receiving the ball 4 in the rest position and preferably of securing it against the undesirable rolling by accommodating it, to the extent of about one half of its body, in a depression (nest 29), the radius of which is slightly greater than the radius of the ball 4, to prevent jamming.

If the cup-shaped space surrounding nest 29 within sealing element 3 is substantially higher than appears necessary to house the ball 4, the possiblity of the ball 4 straying backwards into the return guide 37 and thereby disturbing the operation is reliably eliminated.

Unintentional opening, due to friction between the outer cap and the inner cap, is also prevented by reliably excluding unintended engagement, without coupling being brought about by the ball 4, by the following: the working edges 26 of the outer cap 1 are guided upwards on the inclined ramp 20 or 21 of the inner cap 2 when turning the closure in the opening direction, so that the difference in height of the edges 26 and 19*b*, when they meet, is greater than in the position in which they are coupled by means of the ball 4. In order to fulfil this condition it is necessary that the amounts by which the guide edge 22*a* slides upwards is at least sufficient that this edge 22*a* clears the lower edge 19*b* before the working edge 26 has reached the end of the ramp 21.

Figure 6:
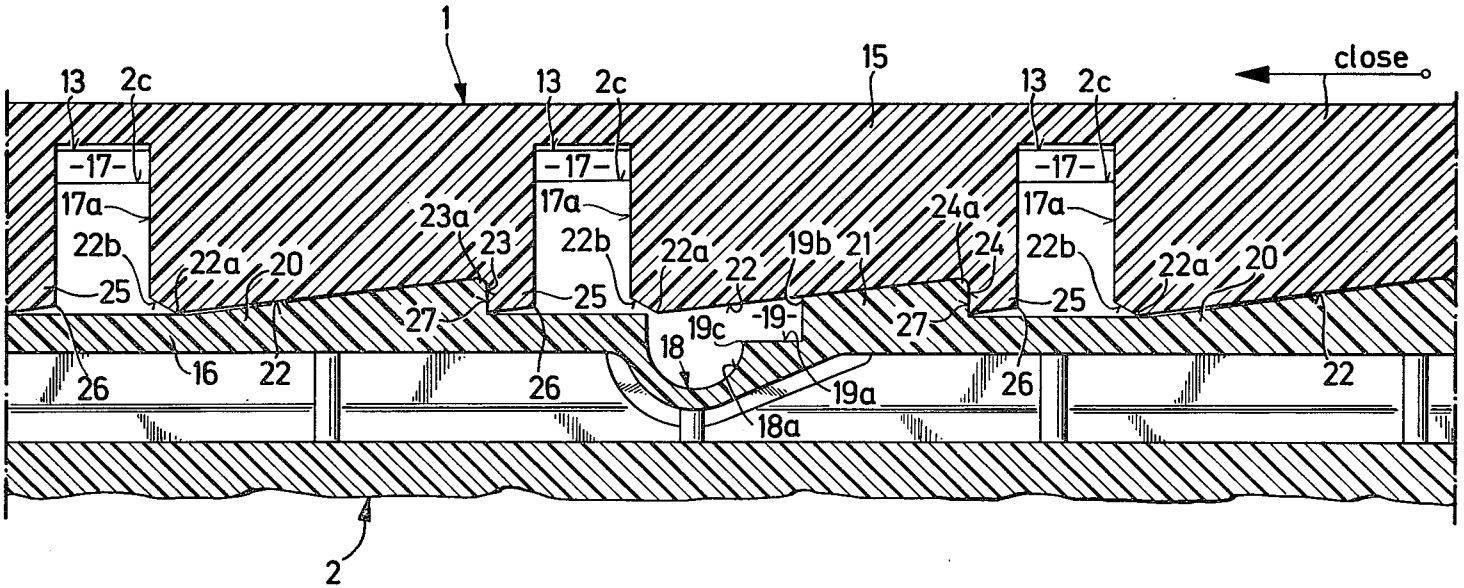
FIG. 6 shows a similar unwrapped view of the same zone, but in the unlocked position, and this zone of contact lying along a cylindrical mantle surface indicated by V,VI-V,VI in FIG. 1.

The chamfer of the guide edge 22*a* is intended to prevent premature, unreliable engagement between the vertical face 22*b* of the outer cap 1 and the vertical gripper face 23 or 24 of the inner cap 2, on turning the closure in the closing direction (FIG. 6).

Accordingly, the closure of the invention meets a double safety requirement by extremely simple means. Firstly, it is virtually impossible to open the closure without knowledge of the procedure to be followed, whilst on the other hand even old and infirm persons, even if they are blind or in the dark, can open the closure simply and reliably.

At the same time, the closure of the invention externally in no way differs from a conventional screw-cap closure and thus gives a small child no clue as to the procedure to be followed for opening, all the more so since the outer cap 1 can be turned indefinitely in the opening direction, without offering resistance.

Effortless opening is ensured by the fact that no intricate or sensitive manipulations are necessary, and instead all that is needed is to execute two movements, with relatively large tolerance, with the closed container 7, and furthermore there is no problem of carrying the movements in the specified sequence, before unscrewing the closure. On next closing the container 7, the safe state of the closure is automatically restored.

I claim:

1. A child-proof screw-cap closure with
(a) an inner cap which can be screwed onto the dispensing orifice of a container,
(b) an outer cap which covers the said inner cap and, in the non-actuating position, is rotatably carried thereon without causing it to execute the same movement,
(c) a coupling member which, when the closure is actuated to open it, produces a positive engagement between the inner cap and the outer cap, and
(d) a sealing member which can be applied between the orifice rim of the container and the inner wall of the inner cap, said inner cap possessing, on its inside, an inner chamber which faces the container, and also possessing a cavity in its upper end face which chamber and cavity are connected with one another by a first passage which at all times freely permits the coupling member to pass; said inner cap having a second ball-circulating channel which connects said cavity with said chamber, said second channel having a window in the outer side wall of the inner cap, between said cavity and said chamber, and said outer cap having, on its inner wall, a projecting zone with at least one niche, which zone projects so far into the interior of the outer cap that, in the non-actuating position, it at least partially covers said window of said ball-circulating channel and thereby prevents passage of the coupling member through the said channel, whilst, when the outer cap is rotated so that said niche faces said window, said coupling member can pass from said cavity into said window, whilst at the same time projecting into said niche, as a result whereof a positive engagement is established between said inner cap and said outer cap, and both said caps can be unscrewed from the mouth of said container.

2. A screw-cap closure as described in claim 1, wherein said inner cap has a recess in the side wall thereof which recess extends below said window and is deeper than the lower edge of said niche in the inner wall of said outer cap, and wherein said coupling member, when projecting into said niche, rests against the bottom face of said recess.

3. A screw-cap closure as claimed in claim 2, wherein the zone of said window in said outer side wall of said inner cap has a step therein, the reach of said ball-circulating channel between said window and said cavity terminating above said step, and the reach of said channel between said window and said chamber terminating below said step in said side wall of said inner cap and being so staggered relative to an orifice of said first reach of said channel, in the direction in which the closure is rotated to close it, that the coupling member when projecting into the niche of the outer cap is pushed into an opening of said second reach of said channel on turning the outer cap in the closing direction, said coupling member being able to leave said niche, whereby said outer cap and said inner cap become disengaged.

4. A screw-cap closure as claimed in claim 3, wherein said second reach of said channel has an entry into said chamber which entry is so designed that the coupling member is prevented from entering said second reach from said chamber.

5. A screw-cap closure as claimed in claim 4, further comprising a locking device between said outer cap and said inner cap, by means of which locking device said inner cap is carried with said outer cap when the latter is rotated in the closing direction, whilst said inner cap is released when rotating said outer cap in the opening direction.

6. A screw-cap closure as claimed in claim 5, wherein the marginal edge of said niche in said inner wall of said outer cap, which on rotation of the latter in the opening direction is brought into contact with said coupling member projecting into said niche, is so arranged relative to the coupling marginal edge of said window of said inner cap above said step against which said coupling member is pressed on rotating the closure to open it, that, with said coupling member removed from said niche, said edge of said niche does not come into engagement with said coupling marginal edge.

7. A screw-cap closure as claimed in claim 6, wherein the annular step adjacent to said window in said outer wall of said inner cap has ramps which rise in the opening direction of rotation, and said inner wall of said outer cap has an annular shoulder comprising lifting faces, said ramps being of sufficient length so as to prevent engagement between said niche edge and said coupling marginal edge by raising said lifting faces, sliding on said ramps.

8. A screw-cap closure as claimed in claim 7, wherein said coupling member is a ball of said closure.

9. A screw-cap closure as claimed in claim 8, wherein said sealing member is firmly connected to said inner cap so as to seal said inner chamber and prevents said coupling member from dropping out.

10. A screw-cap closure as claimed in claim 9, wherein said sealing element has a cavity on its side which faces said inner chamber of said inner cap, in which cavity said coupling member is held securely, to prevent a shift in its position, when said inner cap is in the normal upright position.

* * * * *